United States Patent [19]

Stahlkopf

[11] Patent Number: 4,564,340

[45] Date of Patent: Jan. 14, 1986

[54] DEVICE FOR REGULATING THE PRESSURE AND FEED VOLUME OF A DIAPHRAGM PUMP

[75] Inventor: Friedrich R. R. Stahlkopf, Büchen, Fed. Rep. of Germany

[73] Assignee: Abel Pumpen GmbH, Büchen, Fed. Rep. of Germany

[21] Appl. No.: 670,535

[22] Filed: Nov. 13, 1984

[30] Foreign Application Priority Data

Nov. 12, 1983 [DE] Fed. Rep. of Germany ..... 3341020

[51] Int. Cl.[4] ..... F04B 43/10

[52] U.S. Cl. ..... 417/388; 417/385

[58] Field of Search ..... 417/383, 385, 384, 387, 417/388

[56] References Cited

U.S. PATENT DOCUMENTS

| | | | |
|---|---|---|---|
| 2,303,597 | 12/1942 | Adelson | 417/386 X |
| 2,959,131 | 11/1960 | Shoosmith | 417/383 |
| 3,075,468 | 1/1963 | Eifel | 417/388 |
| 3,107,624 | 10/1963 | Williams | 417/388 X |
| 3,257,952 | 6/1966 | McCormick | 417/383 |
| 3,367,270 | 2/1968 | Schlosser | 417/388 |

FOREIGN PATENT DOCUMENTS

| | | | |
|---|---|---|---|
| 953489 | 11/1956 | Fed. Rep. of Germany | 417/388 |
| 1041562 | 10/1953 | France | 417/388 |

*Primary Examiner*—Leonard E. Smith

*Attorney, Agent, or Firm*—Karl F. Ross; Herbert Dubno

[57] ABSTRACT

A device for regulating in a practically loss-free manner the pressure and feed volume of a diaphragm pump which is constructed as a hydraulically activatable displacement pump and is especially suited for feeding a viscous and abrasive or a solids-laden secondary fluid medium. In the device, access is required only to the environment of the primary working fluid medium, and no direct interchanges between the secondary medium being fed and parts of the control device are required. During the pressure phase of the diaphragm pump, a limited quantity of the primary working medium is extracted from a portion of the housing of the device which is in direct and uninterrupted communication with the associated working section, while during the suction phase and in dependence on the overpressure of the primary working fluid medium in the device a compensation is made for the quantity of the primary working fluid medium lost during the pressure phase. The arrangement is such that at a pressure below an adjustable threshold pressure, a complete compensation is effected, while at a pressure above such a threshold pressure an incomplete compensation is effected which becomes more so as the difference between the overpressure and the threshold pressure increases, and that during the suction phase, proportional to the increasing compensation deficit, the primary working fluid medium within the associated working section of the pump is charged with gas from the surrounding atmosphere of the diaphragm pump.

10 Claims, 3 Drawing Figures

DEVICE FOR REGULATING THE PRESSURE AND FEED VOLUME OF A DIAPHRAGM PUMP

FIELD OF THE INVENTION

This invention relates to a device for regulating the pressure and feed volume of a diaphragm pump.

BACKGROUND OF THE INVENTION

A diaphragm pump of the class with which the present invention is concerned generally includes a pumping section traversed by a secondary fluid medium to be delivered from one location to another and a working section charged with a primary working fluid medium, the pumping section and the working section being coupled by means of a connecting fitting through which the primary working fluid medium flows. A diaphragm of elastomeric material is adapted to be pulsatingly acted on by the working fluid medium and defines a part of the boundary of a pump chamber in the pumping section. The associated device for regulating the pressure and feed volume of the pump includes outlet and overpressure valves controlled by the primary working fluid medium in the working section of the pump for the admission and discharge of primary working fluid medium from and into a reservoir. The pump further includes a pressure regulating valve, an expansion chamber and a leakage bore-equipped nozzle for discharging into the reservoir any portion of the primary working fluid medium from the portion of the regulating device separated by the overpressure valves from the working section of the pump.

In a known regulating device of this type, such as is disclosed, for example, in German OLS No. 31 21 103, the portion of the primary working fluid medium which during the pressure phase is lost by being discharged through the nozzle into the reservoir, serves the purpose that during the following suction phase of the involved working section of the pump reduction in the quantity of primary working fluid medium in the working section creates an underpressure condition by means of which a secure engagement between the tubular diaphragm and its supporting pipe is achieved before, as a consequence of the existing underpressure condition in the system, the suction valve is opened for compensating for the missing primary working fluid medium. Although the known regulating device fulfills the objective of a loss-free control of the pressure and feed volume of the secondary fluid medium being transported, it suffers from a number of drawbacks and disadvantages. One of these is that during the suction stroke the end position of the diaphragm must be mechanically effected and transmitted to the valve actuated by the diaphragm. This requires special measures to be taken in regard to the construction of the regulating device, which not only makes the device more expensive but could also adversely influence the operational reliability of the diaphragm pump. Another disadvantage is that the regulating valve which is controlled by the pressure of the secondary fluid medium being transported is directly connected with the pressure expansion chamber, so that the control piston or diaphragm of the latter could possibly come into direct contact with the abrasive or chemically corrosive fluid medium being transported. The regulating valve thus is subjected to high mechanical and/or chemical demands and thus could constitute a point of weakness in the overall system. In the event of leakage at the regulating valve, furthermore, the secondary fluid medium could get into the flow system of and contaminate the primary working fluid medium, which under certain conditions could lead to the diaphragm pump being damaged or destroyed.

OBJECTS OF THE INVENTION

It is an object of the present invention, therefore, to provide a novel and improved regulating device of the class described which enables the pressure and feed volume regulation to be effected in a practically loss-free manner and requires only modification of the environment of the primary working fluid medium.

It is also an object of the present invention to provide such a device in which direct interactions between the secondary fluid medium being transported and the parts of the regulating device are effectively eliminated.

SUMMARY OF THE INVENTION

Generally speaking, the objectives of the present invention are attained through the following considerations:

(a) During the pressure phase of the diaphragm pump, a limited quantity of the primary working fluid medium is diverted into the reservoir from the region of the housing connected with the respective working section of the pump.

(b) During the suction phase and in dependence on the overpressure of the primary working fluid medium in the regulating device, the diversion of the primary working fluid medium which was effected during the pressure phase is compensated for, so that when the pressure in the system is below an adjustable threshold pressure of the regulating device a complete compensation is realized, while when the pressure is above the threshold pressure an incomplete compensation is realized which becomes greater (i.e. more incomplete) as the difference between the overpressure and the threshold pressure increases.

(c) During the suction phase and proportional with the increasing under-compensation, the primary working fluid medium in the associated working section is charged with gas from the surrounding environment of the diaphragm pump.

For the attainment of these objectives the present invention provides a structural combination having the following characteristics:

(a) The regulating device includes a second portion which is in direct and uninterrupted communication with an associated working section of the pump, and a second nozzle with a leakage bore is arranged at the second portion of the regulating device and establishes communication between the second portion of the regulating device and the reservoir.

(b) A recovery channel having an inlet opening in communication with the reservoir leads from the inlet opening to the suction valves, and a throttling device is associated with the inlet opening for controlling the same, the throttling device including an operating chamber having at one part thereof an access opening which is in communication with the first portion of the regulating device, a piston fluid-tightly slidable in the operating chamber and having first and second faces directed, respectively, toward and away from the access opening, a throttle element arranged at the inlet opening and mechanically rigidly connected with the piston, and a biasing spring bearing on the second face of the piston and having associated therewith means for adjusting the biasing force of the spring, the spring being operable normally to bias the throttle element away from the inlet opening to maximize the open area thereof, and the piston being operable, upon being displaced in the operating chamber against the force of the spring by primary working fluid medium acting on the first face of the piston via the access opening, to displace the throttle element so as to progressively reduce the open area of the inlet opening, and (c) a gas charging device communicates with the second portion of the regulating device, the gas charging device including an entrance opening to the second portion of the regulating device, a normally closed spring-biased gas-admitting valve controlling the entrance opening, and an intake pipe located in the reservoir and extending from the gas-admitting valve to a point higher than the highest permissible level of primary working fluid medium in the reservoir, the gas-admitting valve being operable to open and enable gas from the interior of the reservoir to be drawn into the second portion of the regulating device to compensate at least partially for losses of primary working fluid medium from the working section.

BRIEF DESCRIPTION OF THE DRAWING

The foregoing and other objects, characteristics and advantages of the present invention will be clearly understood from the following detailed description thereof, when read in conjunction with the accompanying drawing, in which.

SPECIFIC DESCRIPTION

Figure 1:
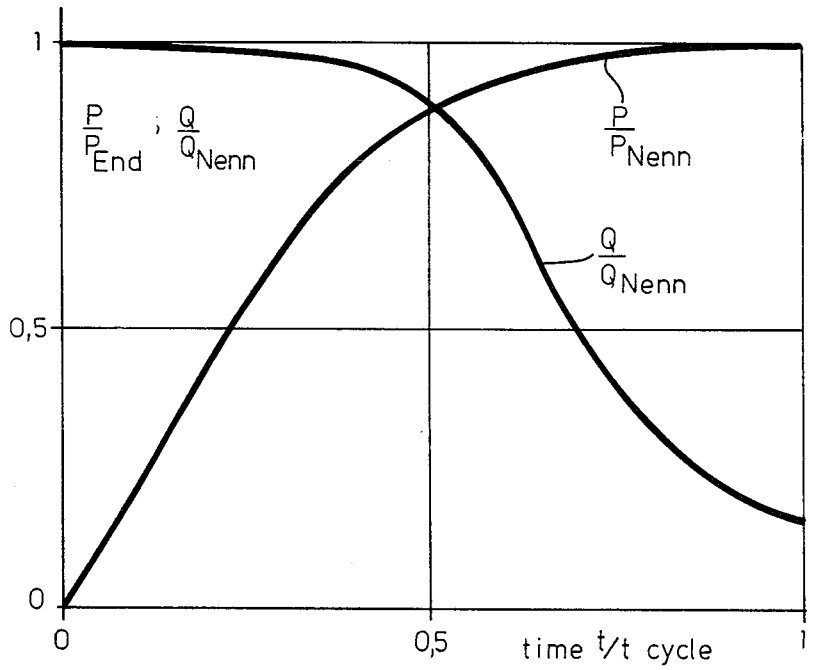
FIG. 1 is a graph for illustrating the qualitative variations of a pressure and feed volume of a filter press in dependence on time.
Figure 2:
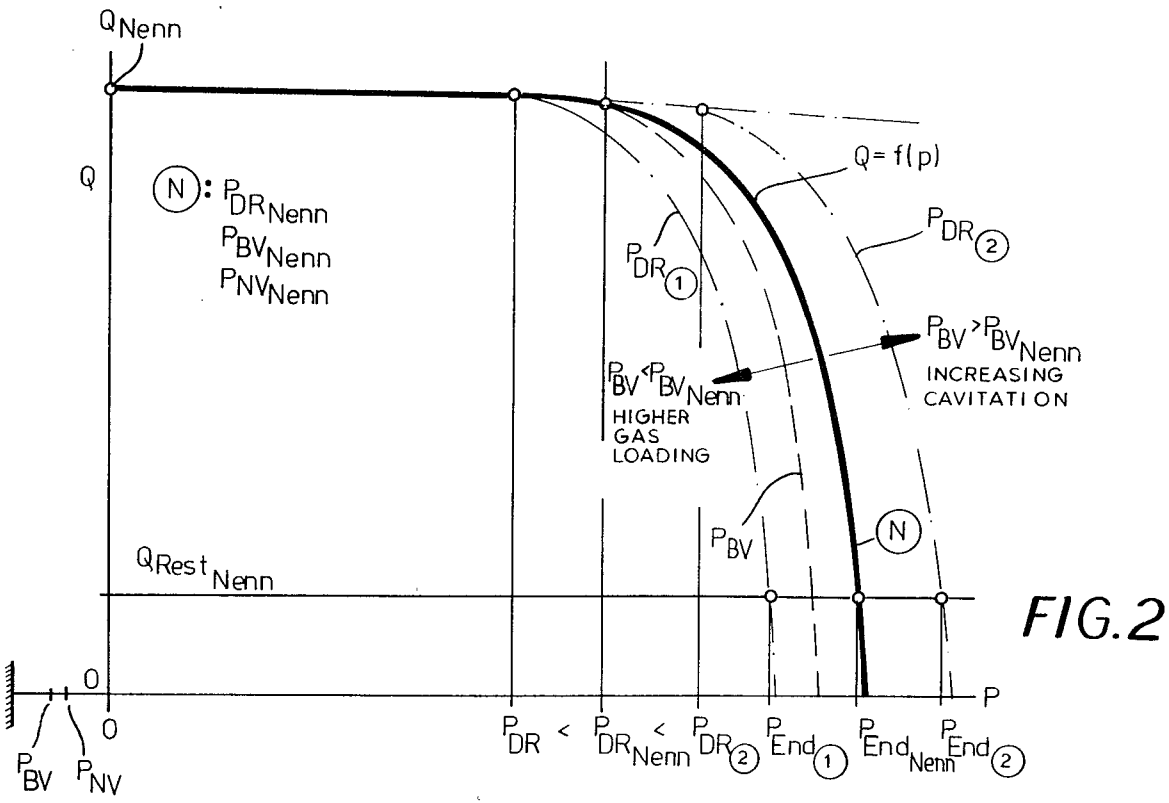
FIG. 2 is a graph for showing the characteristic curve of a diaphragm pump which can be realized by the implementation of the present invention and which can be derived from the curves shown in FIG. 1.

Referring now to the drawing in greater detail, the requisite characteristic curve of a diaphragm pump for a filter press is shown in FIG. 2. The associated values of pressure and feed volume are derived by recording the related values of pressure and feed volume over a predetermined period of time in a Q-p diagram. The heavy solid-line curve $Q=f(p)$ shown in FIG. 2 then represents the characteristic curve of a diaphragm pump which can be regulated practically loss-free, pursuant to the basic objective of the present invention, and which feeds liquid to a filter press corresponding to the Q-p ratio per unit of time illustrated in FIG. 1. It will be recognized from FIG. 2 that the pump regulation starts upon the feed pressure reaching the value $p=p_{DR,Nenn}$. The feed volume Q decreases continuously in dependence on the feed pressure p and reaches the residual of feed volume $Q_{Rest,Nenn}$ when the pressure is $p=p_{End,Nenn}$. The curves shown in FIG. 2 will be more fully discussed presently, after the basic construction of the regulating device according to the present invention, as shown in FIG. 3, has been described.

Figure 3:
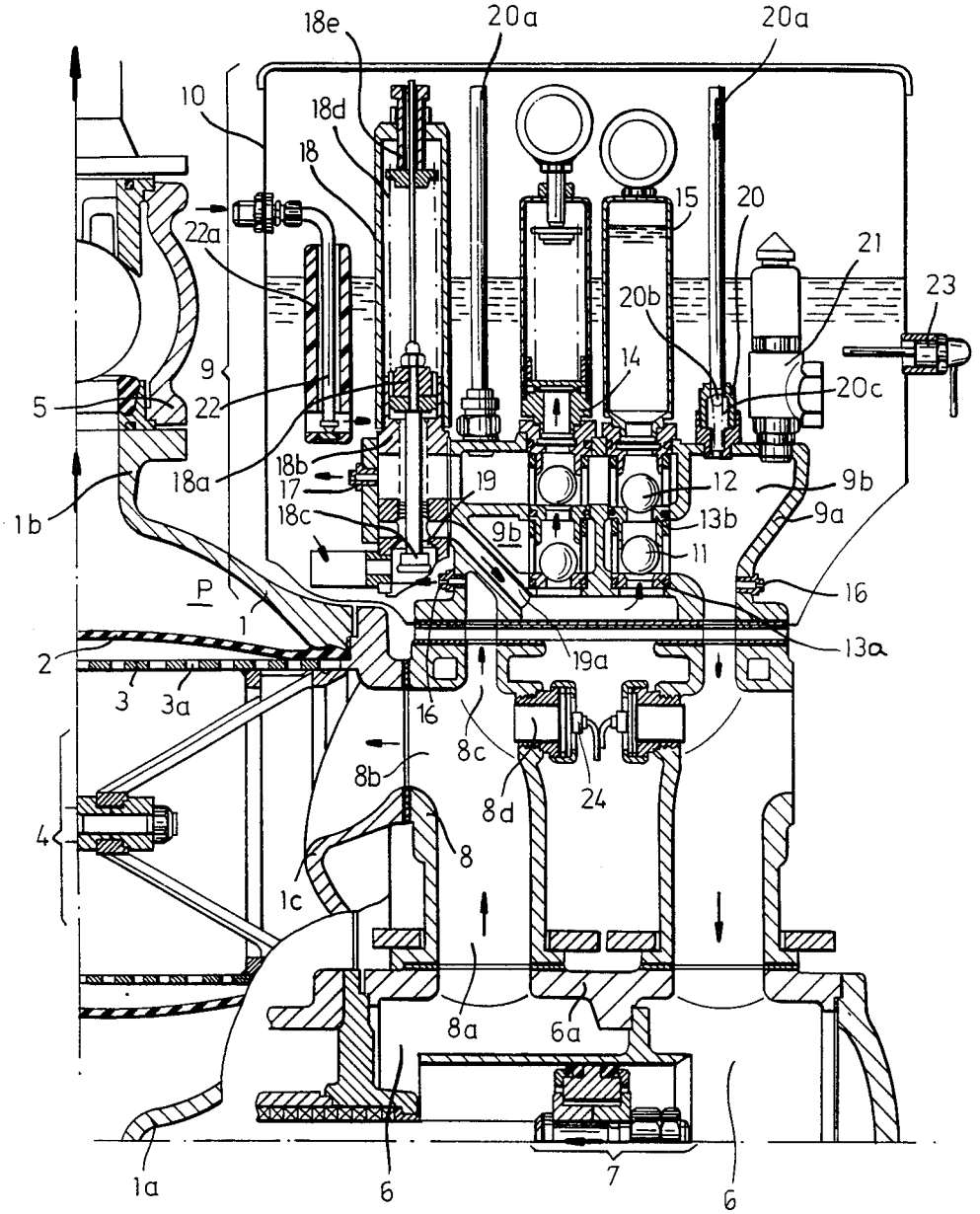
FIG. 3 is a section through a device for regulating the pressure and feed volume of a diaphragm pump according to the present invention, with the illustration being primarily concerned with the functional interrelationships and less with the geometric and structural relationships of the pump.

Referring now to FIG. 3, it will be seen that the diaphragm pump in the illustrated embodiment of the invention includes a ball-shaped housing 1 which has at its lowest end a suction or intake fitting 1*a* and at its uppermost end a pressure or discharge fitting 1*b*. In the right-hand half of the ball housing shown in the drawing there is provided a centrally arranged opening which includes a connecting flange 1*c*. Internally of the ball housing 1 there is located a tubular membrane or diaphragm 2 which overlies in surrounding relation a support pipe 3 provided with a plurality of circumferentially distributed apertures 3*a*. At both its ends the tubular diaphragm is gripped in respective centrally disposed openings of the ball housings 1 and against the proximate ends of the pipe 3 by means of a diaphragm gripping or clamping device 4. The pump chamber P, which receives the secondary fluid medium to be transported and is traversed by the same is a part of the pumping section 1-4 and is bordered by the inner surface of the ball housing 1 and the outer surface of the tubular diaphragm 2. On both the suction fitting 1*a* and the pressure fitting 1*b* there are located identically constructed check valves, of which in the drawing only the check valve 5 on the pressure side is shown.

The illustrated diaphragm pump is constructed as a double-acting single-cylinder pump and is characterized by the fact that in the cylinder thereof (which is only partially and schematically shown at the bottom of FIG. 3) there are provided two working sections 6 which are in communication with the pumping section 1-4 each via associated connection openings in the cylinder housing 6*a* and a connecting fitting 8. A piston 7 arranged in the cylinder housing 6*a* creates, by virtue of its to and fro movements in the working sections 6, alternating suction and pressure phases, so that the primary working fluid medium contacting the piston 7 is in an alternating sequence sucked into and forced out of the associated working section 6.

In a double-acting single-cylinder pump, the overall pump arrangement generally includes two pumping sections 1-4 separated from each other. FIG. 3 should thus be viewed as partially illustrating only the pumping section associated with the left working section 6. The hereinafter described regulating device is not, however, limited to ball-shaped housings utilizing tubular diaphragms or membranes. The principle of the present invention can also be applied without limitation to housings of other forms and equipped with planar diaphragms or membranes. In the case of 4-way dual-cylinder pumps, i.e. in the case of an arrangement of four separate pump sections 1-4, there would have to be provided two of the hereinafter described regulating devices.

As further shown in FIG. 3, the regulating device 9 is connected with the two connecting fittings 8 which are provided in the illustrated embodiment of the invention, and the device is located in its entirety within a reservoir 10 which is fixed between the connecting fittings 8 and the housing 9*a* of the regulating device and at those locations is provided with openings sealed to the outside. Each connecting fitting 8 provides four connections, via the opening 8*a* to the working section 6, via the opening 8*b* to the pumping section 1-4, via the opening 8*c* to the regulating device 9, and via the opening 8*d* to a conductivity sensor 24.

In the housing 9*a* of the regulating device 9 there are provided suction channels 9*b* arranged symmetrically with respect to one another, each of which provides a connection for the associated connecting fitting 8 and thus is in direct and uninterrupted communication with the associated working section 6. Symmetrically with respect to the axis of symmetry of the housing of the device 9, there is further provided a set of valves consisting, in each case, of a suction valve including a suction valve seat 13*a*, a valve ball 11 and an only diagrammatically indicated spring biasing the valve ball 11 toward its seat 13*a*, and of an overpressure valve including an overpressure valve seat 13*b*, a valve ball 12 and an only diagrammatically indicated spring biasing the ball 12 toward its seat 13*b*. The valve seat 13*a*, which communicates with a recovery channel 19*a* having an inlet opening 19, establishes a communication between the suction valve 11-13*a* and the reservoir 10. In the region of each suction or intake channel 9*b* there is arranged in the housing 9*a* of the regulating device a respective lower nozzle 16 with a leakage bore which establishes communication between the reservoir 10 and the suction channel 9*b*.

In the space defined in the housing of the regulating device 9 above the overpressure valve ball 12, which space can communicate with the suction channel 9*b* via the valve seat 13*b*, there is arranged a single upper nozzle 17 with a leakage bore. Over and above this, the mentioned space is connected with a pressure regulating valve 14 and expansion chamber 15.

Also arranged on the housing 9*a* of the regulating device 9 is a throttling device 18. The throttling device includes an operating chamber in which is disposed a piston 18*a* one face of which is subjected to the pressure of the primary working fluid medium disposed in the space above the overpressure valve ball 12, i.e. in the portion of the regulating device 9 which communicates with the upper nozzle 17, via an access opening provided in the lower head 18*b* of the operating chamber. The piston 18*a* is guided with a tight seal in the operating chamber and can be adjusted to a desired threshold pressure $p_{DR}$ by means of a pretensioning device 18*e* including a biasing spring 18*d*. The piston 18*a* is mechanically rigidly connected with a throttle cone or other element 18*c* which controls the inlet opening 19 of the recovery channel 19*a*, in such a manner that upon displacement of the piston 18*a* against the force of the spring 18*d* the open area of the opening 19 is increasingly reduced.

In the region of the suction channel 9*b*, the housing 9*a* of the regulating device accommodates a gas charging valve 20 which includes a suction or intake pipe 20*a* extending to above the highest permissible level of the primary working fluid medium in the reservoir 10 and a closure or valve member 20*b* biased opposite to the ambient pressure of the diaphragm pump by a spring 20*c*. In addition there is provided in the region of the suction channel 9*b* for emergency cases a safety or blow-off valve 21.

Further arranged in the reservoir 10, at a location corresponding to the required level of the primary working fluid medium, is a valve 22 controlled by a float 22*a* and having its throughput capacity predetermined for replacing working fluid medium lost through normal leakage. The valve 22 is connected with an inlet duct for the primary working fluid medium. A level sensing device 23 capable of distinguishing between air or gas and the liquid primary working fluid medium is arranged on the reservoir 10 and has, at a location corresponding to the lowest permissible filling height, a sensing structure that is adapted, when contacted by gas or air, to cause a signal device to generate a suitable signal that either switches on an audible alarm or shuts the diaphragm pump off altogether.

The conductivity probe or sensor 24 is adapted to distinguish between liquids in accordance with their electrical conductivities. As shown, it has a sensing structure located interiorly of the connecting fitting 8 and adapted to cause a signal device (which may be the same one as that mentioned above) to generate, when the conductivity of the primary working fluid medium differs from a prescribed normal conductivity value therefor, a suitable signal that will either actuate an audible alarm or will shut down the pump altogether.

In order to comprehend the operation of the device according to the present invention, let it be assumed that the pumping section 1-4 connected with the left-hand connecting fitting 8 is operating in its pressure phase and that the feed pressure p is lower than the threshold pressure $p_{DR}$ established by the adjustable throttling device 18. In that event, the piston 18*a* is in its lowest end position, so that the open area of the inlet opening 19 communicating with the recovery channel 19*a* is at its maximum. A small quantity of the primary working fluid medium is sucked from the reservoir 10 via the recovery channel 19*a* and the opening 19. As a consequence of the then existing underpressure, the suction valve ball 11 leaves its valve seat 13*a* to enable primary working fluid medium to flow into the working section 6 which is then in its suction phase. The left-side suction channel 9*b* is, therefore, being charged with primary working fluid medium by the proximate face of the piston 7. The primary working fluid medium fed during the pressure stroke raises the left-side overpressure valve ball 12 from its underlying valve seat 13*b*. At this time the right hand overpressure valve ball 12 functions as a check valve and remains on its valve seat, inasmuch as at the same time the suction stroke acts on its underside. As a consequence of the overpressure both in the left-side suction channel 9*b* and in the space above the overpressure valve 12, small quantities of the primary working fluid medium leave the housing 9*a* of the regulating device 9 via the lower and upper nozzles 16 and 17. During the immediately following left-side suction stroke, the lost quantity of primary working fluid medium is compensated for without difficulty through the left-side suction valve 11-13*a*. At this time the right-side valves are subject to the pressure phase, during which a small quantity of the primary working fluid medium is again lost into the reservoir 10 via the upper nozzle 17 and the right-side lower nozzle 16, which loss is then compensated for by the next succeeding suction stroke through the suction valve.

The loss of primary working fluid medium through the lower nozzle 16 has the effect that the tubular diaphragm or membrane 2 is drawn against the support pipe 3 during the suction phase, before the piston 7 reaches its dead center point. The loss of primary working fluid medium through the single upper nozzle 17 reduces to a minimum the pressure deviations that may occur during the regulating operation and ensures a faultless operation of the overpressure valves 12-13*b*.

The operation according to the present invention, of a diaphragm pump which is driven as a feed pump, will now be described with reference to FIG. 2. As there is shown, the characteristic curve realized by means of such an arrangement has a flat or constant segment in the pressure range from $p=0$ to $p_{DR,Nenn}$. As soon as the feed pressure p then becomes greater than the threshold pressure $p_{DR,Nenn}$ set by the throttling device 18, the latter begins to work in such a way that the piston 18*a* being subjected at its lower face to the primary working fluid medium, leaves its lowest end position and moves upwardly against the force of the biasing spring 18*d*. As the feed pressure increases, the throttle element 18*c* enters into the inlet opening 19 and progressively reduces the open area thereof. As a consequence, the working sections 6 then in their suction phase are no longer able to compensate completely, by sucking primary working fluid medium from the reservoir 10, for the loss of primary working fluid medium during the preceding pressure phase. The underpressure in the primary working fluid medium thus becomes so great that the gas charging device 20, the threshold pressure $p_{BV}$ of which is adjustable and lies below the threshold pressure $p_{NV}$ of the suction valves 11-13*a*, aspirates air or gas from the surrounding atmosphere of the diaphragm pump into the suction channel 9*b* of the regulator housing 9*a* through the intake pipe 20*a* extending to above the level of the primary working fluid medium in the reservoir 10. By means of this charging of gas into the primary working fluid medium in accordance with the present invention, the possibility of cavitation in the primary working fluid medium is impeded, which has the advantage that the development of loud noises and the occurrence of damage to structural components, which cavitation can cause, are minimized.

The segment of the heavy solid-line characteristic curve realized through the operation of the throttling device 18 and the gas charging device 20 is shown in FIG. 2 as extending over the feed pressure range from $p=p_{DR,Nenn}$ to $p_{End,Nenn}$. (The term "Nenn" denotes nominal.) When the feed pressure $p=p_{End,Nenn}$ is reached, only a residual quantity $Q_{Rest,Nenn}$ of the secondary fluid medium is fed. At that pressure, the inlet opening 19 leading to the recovery channel 19*a* is completely closed by the throttling device 18, so that the quantities of primary working medium fluid lost through the lower and upper nozzles 16 and 17 cannot be even partially compensated for any more. More and more primary working fluid medium is thus withdrawn from the regulating device 9, so that even during the pressure phase of the particular pumping sections no primary working fluid medium is extracted through the nozzles 16 and 17 but rather only gas or air. The regulating device 9 in this operating condition works with the respectively associated working sections 6 and with a relatively large volume of air which, constituting in effect a dead space, reduces the feed volume of the pump to the previously mentioned residual feed volume.

The dot-dash curves in FIG. 2 illustrate qualitatively how the characteristic curve of the diaphragm pump is altered by an increase or a decrease of the threshold pressure $p_{DR}$ relative to the nominal threshold pressure $p_{DR,Nenn}$. At a threshold pressure $p_{DR1}$ which is smaller than the nominal threshold pressure $p_{DR,Nenn}$, the regulation stops at an earlier point, so that the residual feed volume $Q_{Rest,Nenn}$ is reached at a feed pressure $p=p_{End1}$ which is smaller than $p_{End,Nenn}$. In the case of a threshold pressure $p_{DR2}$ which is greater than the nominal and threshold pressure $p_{DR,Nenn}$, the reverse relationship is true.

The dash-dash curve in FIG. 2 is intended to illustrate the effect of an increase in the threshold pressure $p_{BV}$ of the gas charging device relative to a nominal threshold pressure $p_{BVNenn}$. It will be recognized that the downward slope of the curve is greater, so that the residual feed volume $Q_{Rest,Nenn}$ is reached at a feed pressure p which is less than the nominal feed pressure $p_{End,Nenn}$. In the case of a reduction of the threshold pressure $p_{BV}$ of the gas charging device relative to the nominal threshold pressure $p_{BV,Nenn}$, the possibility of increasing cavitation of the primary working medium has to be considered, since by this change in the threshold pressure the time available for the gas charging operation is reduced.

From the foregoing more qualitative than quantitative considerations it will be understood that by a fine tuning of all of the parameters influencing the operating relationships of the diaphragm pump according to the present invention, it is possible to achieve an optimal matching of the characteristic curve of the pump to the requirements of the filter press operation. In practice, of course, the successful solution of such fine tuning and optimization problems will initially be done experimentally by tests run on pump testing equipment following a thorough theoretical evaluation. Experiments have shown that the objects of the present invention, namely to regulate in a practically loss-free manner the pressure and feed volume of a diaphragm pump of the class herein described, by means of the construction of the device for regulating the pressure and feed volume of a diaphragm pump as disclosed herein, have been achieved satisfactorily and through the use of relatively simple mechanical/hydraulic means.

I claim:

1. In a device for regulating the pressure and feed volume of a diaphragm pump which includes a pumping section adapted to be traversed by a secondary fluid medium being transferred, a working section charged with a primary working fluid medium and coupled to said pumping section by a connecting fitting through which the primary working fluid medium flows, and a diahragm of elastomeric material adapted to be pulsed by the primary working fluid medium and constituting a part of the boundary of a pump chamber, said regulating device further including suction and overpressure valves controlled by the primary working fluid medium in the working section for enabling flow of primary working fluid medium out of and into a reservoir therefor, a pressure regulating valve, an expansion chamber, and a nozzle with a leakage bore for permitting flow of primary working fluid medium into the reservoir from a first portion of the regulating device which is separated from the working section by the overpressure valves;

the improvement comprising that:

(a) said regulating device includes a second portion which is in direct and uninterrupted communication with an associated working section of said pump, and a second nozzle with a leakage bore is arranged at said second portion of said regulating device and establishes communication between said second portion of said regulating device and said reservoir, (b) a recovery channel having at inlet opening in communication with said reservoir leads from said inlet opening to said suction valves, and a throttling device is associated with said inlet opening for controlling the same, said throttling device including an operating chamber having at one part thereof an access opening which is in communication with said first portion of said regulating device, a piston fluid-tightly slidable in said operating chamber and having first and second faces directed, respectively, toward and away from said access opening, a throttle element arranged at said inlet opening and mechanically rigidly connected with said piston, and a biasing spring bearing on said second face of said piston and having associated therewith means for adjusting the biasing force, said spring being operable normally to bias said throttle element away from said inlet opening to maximize the open area thereof, and said piston being operable, upon being displaced in said operating chamber against the force of said spring by primary working fluid medium acting on said first face of said piston via said access opening, to displace said throttle element so as to progessively reduce the open area of said inlet opening, and (c) a gas charging device communicates with said second portion of said regulating device, said gas charging device including an entrance opening to said second portion of said regulating device, a normally closed spring-biased gas-admitting valve controlling said entrance opening, and an intake pipe located in said reservoir and extending from said gas-admitting valve to a point higher than the highest permissible level of primary working fluid medium in said reservoir, said gas-admitting valve being operable to open and enable gas from the interior of said reservoir to be drawn into said second portion of said regulating device to compensate at least partially for losses of primary working fluid medium from said working section.

2. In a regulating device as claimed in claim 1, the improvement comprising that a safety valve is provided for each working section of said pump, said safety valve being supported by the housing of said regulating device in communication with the second portion thereof in communication with the associated working section.

3. In a regulating device as claimed in claim 1 or 2, the improvement comprising that a supply pipe for feeding primary working fluid medium from a source thereof into said reservoir communicates at its discharge end with the interior of said reservoir, a discharge valve controls said discharge end of said supply pipe, and a float member adapted to float in the body of primary working fluid medium in said reservoir controls said discharge valve, said float member being adjusted to open said discharge valve upon the level of primary working fluid medium in said reservoir dropping below a prescribed value.

4. In a regulating device as claimed in claim 1 or 2, the improvement comprising that a first sensing device having a first sensing structure giving different responses to gas and primary working fluid medium is provided with said first sensing structure located in said reservoir at the lowest permissible level of primary working fluid medium, and a signal-generating device is connected with said first sensing structure for activating an audible alarm or shutting down said pump in response to said first sensing structure being contacted by gas.

5. In a regulating device as claimed in claim 4, the improvement comprising that a supply pipe for feeding primary working fluid medium from a source thereof into said reservoir communicates at its discharge end with the interior of said reservoir, a discharge valve controls said discharge end of said supply pipe, and a float member adapted to float in the body of primary working fluid medium in said reservoir controls said discharge valve, said float member being adjusted to open said discharge valve upon the level of primary working fluid medium in said reservoir dropping below a prescribed value.

6. In a regulating device as claimed in claim 4 the improvement comprising that a second sensing device having a second sensing structure giving different responses to fluids of different electrical conductivities is provided with said second sensing structure located interiorly of said connecting fitting, and a signal-generating device is connected with said second sensing structure for activating an audible alarm or shutting down said pump in response to said second sensing structure being contacted by a primary working fluid medium, the electrical conductivity of which deviates from a prescribed conductivity value.

7. In a regulating device as claimed in claim 6, the improvement comprising that a supply pipe for feeding primary working fluid medium from a source thereof into said reservoir communicates at its discharge end with the interior of said reservoir, a discharge valve controls said discharge end of said supply pipe, and a float member adapted to float in the body of primary working fluid medium in said reservoir controls said discharge valve, said float member being adjusted to open said discharge valve upon the level of primary working fluid medium in said reservoir dropping below a prescribed value.

8. In a regulating device as claimed in claim 1 or 2, the improvement comprising that first and second sensing devices are provided, said first sensing device having a first sensing structure which gives different responses to gas and primary working fluid medium and is located in said reservoir at the lowest permissible level of primary working fluid medium, said second sensing device having a second sensing structure which gives different responses to fluids of different electrical conductivities and is located interiorly of said connecting fitting, and a signal-generating device is operatively connected with said first and second sensing structures for activating an audible alarm or shutting down said pump in response to either said first sensing structure being contacted by gas or said second sensing structure being contacted by a primary working fluid medium, the electrical conductivity of which deviates from a prescribed value.

9. In a regulating device as claimed in claim 8, the improvement comprising that a supply pipe for feeding primary working fluid medium from a source thereof into said reservoir communicates at its discharge end with the interior of said reservoir, a discharge valve controls said discharge end of said supply pipe, and a float member adapted to float in the body of primary working fluid medium in said reservoir controls said discharge valve, said float member being adjusted to open said discharge valve upon the level of primary working fluid medium in said reservoir dropping below a prescribed value.

10. In a device for regulating the pressure and feed volume of a diaphragm pump which includes a pumping section adapted to be traversed by a secondary fluid medium being transferred, a working section charged with a primary working fluid medium and coupled to said pumping section by a connecting fitting through which the primary working fluid medium flows, and a diaphragm of elastomeric material adapted to be pulsed by the primary working fluid medium and constituting a part of the boundary of a pump chamber, said regulating device further including suction and overpressure valves controlled by the primary working fluid medium in the working section for enabling flow of primary working fluid medium out of and into a reservoir therefor, a pressure regulating valve, an expansion chamber, and a nozzle with a leakage bore for permitting fluid of primary working fluid medium into the reservoir from a first portion of the regulating device which is separated from the working section by the overpressure valves;

the improvement comprising that:

(a) first means are provided for diverting, during the pressure phase of the pump, a limited quantity of the primary working fluid medium into the reservoir from the portion of the regulating device which is connected with the associated working section of the pump, (b) second means are provided for compensating, during the suction phase of the pump, for such diversion of primary working fluid medium, said second means including (i) means defining a threshold pressure for the primary working fluid medium and (ii) means operable (A) to achieve a full compensation when the pressure of the primary working fluid medium is below said threshold pressure and (B) to achieve, when the pressure of the primary working fluid medium is above said threshold pressure, an incomplete compensation which becomes greater as the difference between the overpressure and said threshold pressure increases, and (c) third means are provided for charging gas, during the suction phase of the pump, from the ambient atmosphere of the pump into the primary working fluid medium in said associated working section of the pump and to a degree proportional to the increasing under-compensation.

* * * * *